US005439392A

United States Patent [19]

Rouhier et al.

[11] Patent Number: 5,439,392

[45] Date of Patent: Aug. 8, 1995

[54] PENETRATOR ASSEMBLY CONNECTOR SLEEVE AND SYSTEM COMPRISING SAME

[75] Inventors: Maurice Rouhier, Viroflay; Jean-Louis Striebig, Chennevieres, both of France

[73] Assignee: Framatome Connectors International, Paris La Defense, France

[21] Appl. No.: 156,775

[22] Filed: Nov. 24, 1993

[30] Foreign Application Priority Data

Nov. 25, 1992 [FR] France ..... 92 14196

[51] Int. Cl.[6] ..... H01R 13/74

[52] U.S. Cl. ..... 439/559; 439/587

[58] Field of Search ..... 439/559, 277, 271, 587

[56] References Cited

U.S. PATENT DOCUMENTS 4,334,729 6/1982 Allen et al. ..... 439/550

4,666,228 5/1987 Wood ..... 439/559

FOREIGN PATENT DOCUMENTS 314364 10/1988 European Pat. Off. .

*Primary Examiner*—Gary F. Paumen

*Attorney, Agent, or Firm*—Pollock, Vande Sande & Priddy

[57] ABSTRACT

A penetrator assembly connector sleeve has a hollow cylindrical part carrying seals on its outside surface and a closed first end. It defines a housing for an extension of a cylindrical first connector having a peripheral seal on a diameter substantially equal to that of the outside surface. A penetrator assembly connection system comprises a first connector with a peripheral seal having a front edge including an extension disposed in the housing of a sleeve of the above kind. The sleeve contacts the front edge of the first connector at a second end of the cylindrical part opposite the first end so that when the system is disposed so that the closed end of the sleeve contacts a rear edge of a second connector with a peripheral seal disposed in a penetrator assembly one of the first and second connectors can be replaced by the other by movement in translation without compromising the seal.

6 Claims, 1 Drawing Sheet

PENETRATOR ASSEMBLY CONNECTOR SLEEVE AND SYSTEM COMPRISING SAME

BACKGROUND OF THE INVENTION

1. Field of the invention

The present invention concerns a sleeve for a connector in a penetrator assembly as used in nuclear installations, for example, the penetrator assembly extending through a wall between a "hot" side exposed to radiation and a "cold" side where there is no radiation.

2. Description of the prior art

It is known to fix a connector, such as a male/male adaptor or a male-female adaptor, in a sealing member fastened to the wall using a locking fork movable between a locked position in which it cooperates with a peripheral groove in the connector body and an unlocked position in which the connector is free to move in translation (or rotation) in the cylindrical sealing member. This enables removal of the connector by displacement in translation and its replacement by another connector of the same or a different type, as required.

The connector carries peripheral seals because it also seals the passage through the wall. The problem of maintaining the seal when replacing the connector with another arises in the intended application, specifically at the annular groove receiving the two branches of the locking fork.

Some sockets, such as those of the remotely manipulatable ULC series of applicants' assignees, incorporate pre-guide forks which form an extension.

SUMMARY OF THE INVENTION

An object of the present invention is a device which can solve the problem of maintaining the seal at a penetrator assembly when one connector is replaced by another.

In one of its aspects, the invention consists of a penetrator assembly connector sleeve having a hollow cylindrical part carrying sealing means on its outside surface and a closed first end and defining a housing for an extension of a cylindrical first connector having a peripheral seal on a diameter substantially equal to that of the outside surface. In a preferred embodiment of the invention, the hollow cylindrical part is sufficiently long to receive an extension including a cable of predetermined length.

In another aspect, the invention consists of a penetrator assembly connection system comprising a first connector with a peripheral seal having a front edge including an extension disposed in the housing of a sleeve contacting the front edge of the first connector at a second end of the cylindrical part opposite the first end, so that when the closed end of the sleeve contacts a rear edge of a second connector with a peripheral seal disposed in a penetrator assembly one of the first and second connectors can be replaced by the other by movement in translation without compromising the seal.

The extensions of the first and second connectors advantageously each comprise first and second connector members connected by a cable of given length. Using a long sleeve, a connector fitted with an extension cable can be replaced by a (preferably identical) system. This can solve the problem of replacing a long (one meter, for example) connection, for example a connection through a thick wall, as encountered in nuclear installations.

The first and second connectors may have a first locking member, for example a peripheral groove, adapted to cooperate with a complementary second locking member, for example a locking fork.

The first and second connectors may be male/male or male/female adaptors, for example.

In a preferred embodiment of the invention, the connection system comprises a tubular member having a front part coupled to a cylindrical sealing member in which is housed and sealed the second connector, and a rear part having centering means in an opening of a penetrator assembly, the sleeve being adapted to slide inside the tubular member. The tubular member constitutes an adaptor between the different diameters usually encountered in long penetrator assemblies between the hot and cold sides, continuity of sealing being maintained only at the cylindrical sealing member.

BRIEF DESCRIPTION OF THE DRAWING

Other features and advantages of the invention will emerge more clearly from the following description given by way of example with reference to the drawings.

DETAILED DESCRIPTION OF THE INVENTION

Figure 1:
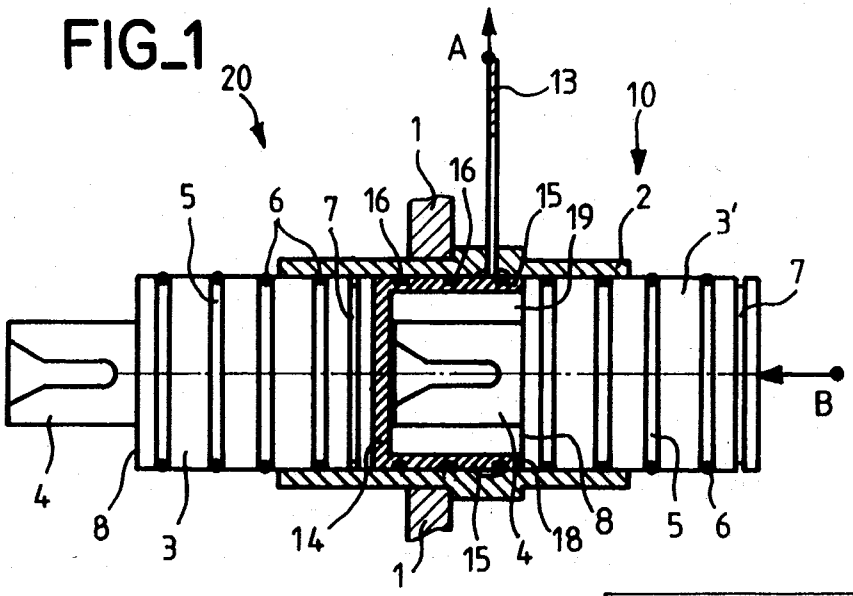
FIG. 1 shows a first embodiment of the invention during the replacement of a connector.

FIG. 1 show a connector 3 having a connector body with peripheral grooves 5 receiving 0-rings 6. The connector 3 has an extension 4 at the front, for example a pre-guide fork (as in the ULC series connectors mentioned hereinabove and grooves 7 at the rear adapted to receive the branches of a locking fork 13 locating the connector longitudinally in a cylindrical sealing member 2. The sealing member 2 is mounted and sealed (for example welded) in an opening in a wall 1 separating a cold part 10 from a hot part 20 of a nuclear installation. For purposes of replacing the connector 3 (shown in the left-hand part of the drawing) with another, preferably identical connector 3' (shown in the right-hand part of the drawing), the invention provides a system comprising in a continuous sequence displacable in the direction B, from left to right:

the connector 3, a hollow cylindrical sleeve having a closed end 14 and a cylindrical part 15 with 0-rings 16 around it, and the connector 3' whose extension 4 is inside a housing 19 in the sleeve.

With the extension 4 of the connector 3' inside the housing 19, the combination of the connector 3' and the sleeve is moved in the direction of the arrow B until the closed end 14 of the sleeve contacts the back of the connector 3 with the cylindrical part 15 against the front 8 of the connector 3'. This ensures continuity of sealing, in particular at the locking forks. A minimal sealing condition is one in which at least one (and preferably two) 0-ring(s) remain on each side of the locking fork 13 in any position of the connector 3/sleeve/connector 3' system as it moves.

Figure 2:
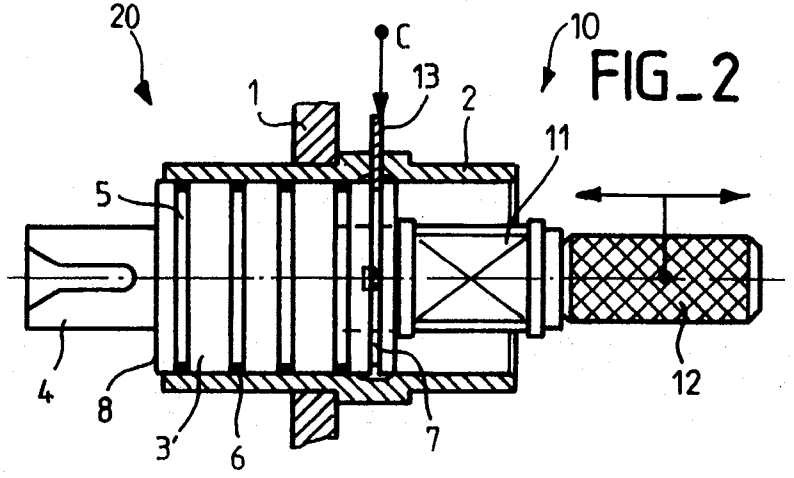
FIG. 2 shows the replacement connector in place.

FIG. 2 shows the connector 3' in place with the locking fork 13 pushed down so that its branches are inserted into the peripheral groove 7, thereby locking the connector 3'. FIG. 2 also shows a manual actuator device having a handle 12 and a front part 11 applied to the back of the connector 3' to push it into place.

On completion of connector replacement, the sleeve (14, 15) is disengaged from the extension 4 using a remotely controlled manipulator on the hot side 20.

Figure 3:
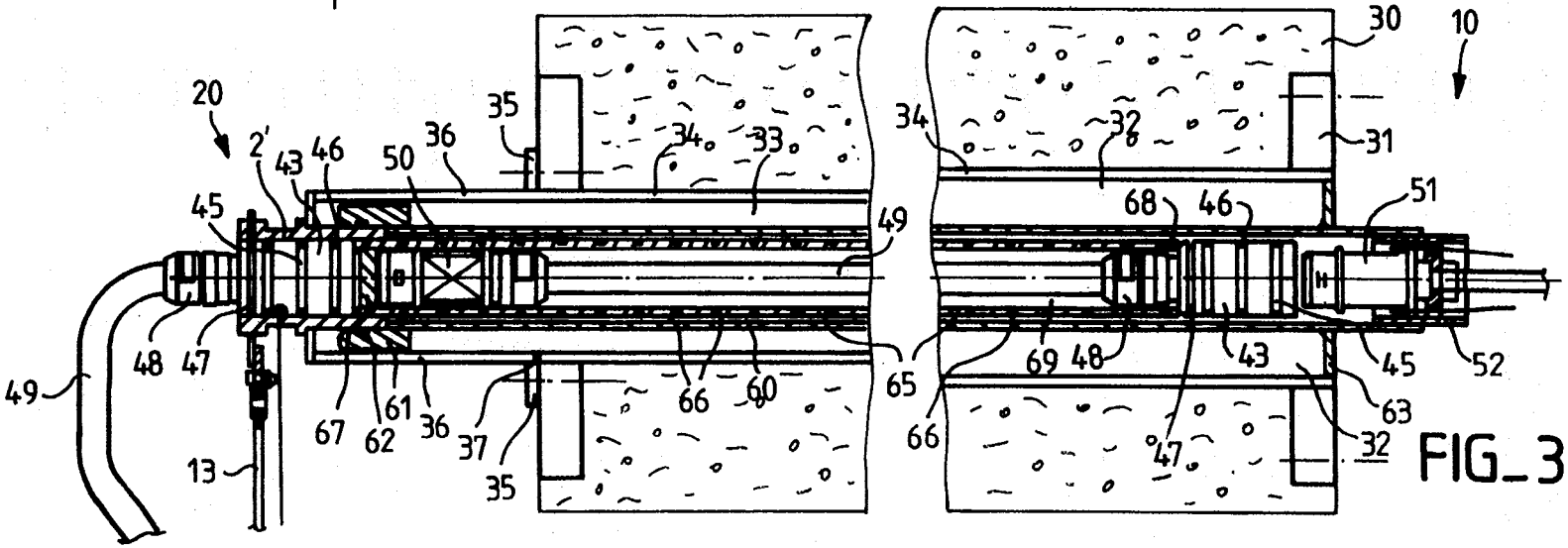
FIG. 3 shows a preferred embodiment of the invention for use in long penetrator assemblies.

FIG. 3 shows a long (one meter, for example) penetrator assembly through a wall 30 between a cold part 10 and a hot part 20 in which the locking fork 13 is located. The thick wall 30 is usually made of concrete in which are openings (32 . . . 33) in several sections of decreasing diameter from the cold side 10 to the hot side 20. The openings (32 . . . 33) have a lining 34 which in the hot part 20, is extended by a cylindrical member 36 with fixings 35 and means 37 for sealing it to the lining 34. A cylindrical sealing member 2' is housed in and sealed to the end of the member 36. It is adapted to receive a connector 43 which has a groove 47 for locking it by means of a fork-type locking system 13. On the hot side 20, the connector 43 is connected to a connector member 48 terminating a cable 49 at the other end of which is a remotely operable connector member 50.

The objective is to replace the assembly 43/48/49/50 with a generally identical assembly, working from the cold side 10, the locking forks being operated under remote control from the hot side 20.

The cylindrical sleeve has a long cylindrical portion 65 along which are regularly spaced 0-rings 66. It has a closed end 67 welded or otherwise sealed to the cylindrical portion 65 and in which the cable 49 and the two connector members 48 and 50 are disposed. The connector member 48 is connected to the connector 43 with peripheral seals 46. To replace the connector, the forks 13 are unlocked by remote control and the sleeve in which the assembly 48/49/50 connected to the end of the connector 43, a connector adaptor, for example, is then inserted closed end 67 first until the closed end 67 contacts the connector 43 to be replaced, which has been released. This displacement continues until the new connector 43 is in place and it is then locked in place by the locking fork 13. The sleeve 65/66/67 can then be removed by remote control or preferably allowed to drop out due to gravity alone.

To take into account the different diameters between the cold side 10 and the hot side 20, a tubular guide member 60 is used which has a front part 61 which fits around the outside diameter of the rear part of the sealing member 2' (preferably with a seal 62) and the other end of which carries centering means 63 in the form of a flange inserted into the opening 32 in the wall 30. This flange is centered by the internal lining 34.

There is claimed:

1. Penetrator assembly connection system comprising first and second connectors each having extensions, the first of said connectors having a peripheral seal and a front edge including a said extension disposed in a housing of a penetrator assembly connector sleeve, said penetrator assembly connector sleeve having a hollow cylindrical part with an outside surface carrying sealing means and a closed first end and defining a housing for said extension of said first connector, said first connector having a diameter substantially equal to a diameter of said outside surface, wherein said sleeve contacts a front edge of said first connector at a second end of said cylindrical part opposite said closed first end so that, when said closed first end of said sleeve contacts a rear edge of said second connector with a peripheral seal disposed in a penetrator assembly, one of said first and second connectors can be replaced by the other of said first and second connectors by translational movement without compromising the sealing.

2. Connection system according to claim 1 wherein the extensions of said first and second connectors each comprise first and second connector members connected by a cable of given length.

3. Connection system according to claim 2 wherein the first and second connectors have a first locking member adapted to cooperate with a complementary second locking member.

4. Connection system according to claim 3 wherein said first locking member is a peripheral groove and said second locking member is a locking fork.

5. Connection system according to claim 1 wherein said first and second connectors are male/female adaptors.

6. Connection system according to claim 1 further comprising a tubular member having a front part coupled to a cylindrical sealing member in which is housed and sealed said second connector and a rear part having centering means in an opening of said penetrator assembly, said sleeve being adapted to slide inside said tubular member.

* * * * *